US009254016B2

(12) United States Patent
Tews

(10) Patent No.: US 9,254,016 B2
(45) Date of Patent: Feb. 9, 2016

(54) DEVICE FOR ADAPTING A SHOE TO ATTACH A CYCLING CLEAT

(71) Applicant: Erik Henry Tews, Santa Cruz, CA (US)

(72) Inventor: Erik Henry Tews, Santa Cruz, CA (US)

(73) Assignee: Erik Henry Tews, Santa Cruz, CA (US)

( * ) Notice: Subject to any disclaimer, the term of this patent is extended or adjusted under 35 U.S.C. 154(b) by 193 days.

(21) Appl. No.: 13/921,211

(22) Filed: Jun. 19, 2013

(65) Prior Publication Data

US 2013/0298428 A1 Nov. 14, 2013

Related U.S. Application Data

(63) Continuation-in-part of application No. 13/009,855, filed on Jan. 20, 2011, now abandoned.

(51) Int. Cl.

| | |
|---|---|
| ***A43B 23/00*** | (2006.01) |
| ***A43B 5/00*** | (2006.01) |
| ***A43B 3/24*** | (2006.01) |
| ***A43C 15/16*** | (2006.01) |
| ***A43B 5/14*** | (2006.01) |
| ***A43B 5/18*** | (2006.01) |

(52) U.S. Cl.

CPC . *A43B 3/24* (2013.01); *A43B 3/246* (2013.01); *A43B 5/14* (2013.01); *A43B 5/185* (2013.01); *A43C 15/16* (2013.01)

(58) Field of Classification Search

CPC ..... A43B 3/24; A43B 3/246; A43B 3/0052; A43B 3/0057; A43B 3/0063; A43B 3/0068; A43B 5/14; A43B 5/85; A43B 13/30; A43C 15/16

USPC ..... 36/131, 114, 132, 134

See application file for complete search history.

(56) References Cited

U.S. PATENT DOCUMENTS

| | | | | | |
|---|---|---|---|---|---|
| 3,845,576 | A | * | 11/1974 | Howland, Jr. | 36/77 R |
| 4,807,372 | A | | 2/1989 | McCall | |
| 5,079,968 | A | * | 1/1992 | Starner | A43B 3/0042 36/131 |
| 5,125,173 | A | * | 6/1992 | Nagano | A43B 5/14 36/131 |
| 5,199,192 | A | * | 4/1993 | Kilgore | A43B 5/14 36/131 |
| 5,205,056 | A | * | 4/1993 | Okajima | A43B 5/14 36/131 |
| 5,363,573 | A | * | 11/1994 | Kilgore | A43B 5/14 36/131 |
| 5,381,708 | A | * | 1/1995 | Liao | B62M 3/086 36/131 |
| 5,446,977 | A | * | 9/1995 | Nagano | B62M 3/086 36/131 |

(Continued)

FOREIGN PATENT DOCUMENTS

| | | |
|---|---|---|
| EP | 1700531 | 9/2006 |
| EP | 2338370 | 6/2011 |
| WO | WO2009153524 | 6/2009 |

*Primary Examiner* — Clinton T Ostrup
*Assistant Examiner* — Cameron A Carter

(57) ABSTRACT

A kit and a method which is used to convert a non-cycling shoe into a cycling shoe which is capable of attaching a cycling cleat. The kit includes a device, fasteners, a template and instructions. The device is a contoured plate which has the appropriate geometry and holes to attach an SPD type cycling cleat. The device may possess ground contact preventing members on the bottom surface to prevent the cycling cleat from contacting the ground while the shoe is used for walking. The template is used to confirm and mark the ideal location for the holes that must be cut thru the shoe sole to accommodate the cleat attachment area and fasteners for the device.

5 Claims, 9 Drawing Sheets

(56) References Cited

U.S. PATENT DOCUMENTS 5,685,093 A * 11/1997 Lin ..... A43B 1/0054 36/131
5,836,094 A * 11/1998 Figel ..... A43B 3/0073 36/131
5,946,754 A * 9/1999 Baldini ..... B62M 3/086 12/123
5,992,266 A * 11/1999 Heim ..... B62M 3/086 74/594.4
6,189,242 B1 * 2/2001 Lin ..... A43B 5/14 36/117.1
6,244,136 B1 * 6/2001 Chen ..... A43B 5/14 36/131
6,898,872 B2 5/2005 McKissic
7,343,702 B2 * 3/2008 Chao ..... A43B 5/14 36/131
2003/0066385 A1 * 4/2003 Blanchette ..... B62M 3/086 74/594.6
2004/0000071 A1 * 1/2004 Auger ..... A43B 5/02 36/59 R
2004/0168347 A1 * 9/2004 LeVine ..... A43B 3/0021 36/8.3
2005/0022432 A1 * 2/2005 Chretien ..... A43B 5/14 36/131
2005/0188567 A1 * 9/2005 Chretien ..... B62M 3/086 36/131
2005/0198868 A1 * 9/2005 Scholz ..... A43B 3/24 36/67 D
2005/0210712 A1 * 9/2005 Jau ..... A43B 5/14 36/131
2006/0010716 A1 * 1/2006 Kerns ..... A43B 5/14 36/25 R
2006/0016102 A1 * 1/2006 Xie ..... A43B 5/14 36/131
2006/0080865 A1 * 4/2006 Chao ..... A43B 5/14 36/131
2006/0201035 A1 * 9/2006 Signori ..... A43B 5/14 36/131
2007/0094898 A1 * 5/2007 Xie ..... A43B 5/14 36/131
2008/0110294 A1 * 5/2008 Bryne ..... A43B 5/14 74/594.6
2009/0320641 A1 * 12/2009 Delgorgue ..... A43B 5/14 74/594.6
2010/0269374 A1 * 10/2010 Hsieh ..... A43B 5/14 36/25 R
2010/0301632 A1 * 12/2010 Bryne ..... A43B 5/14 296/180.1
2010/0307030 A1 12/2010 Tafaute

* cited by examiner

300

DEVICE FOR ADAPTING A SHOE TO ATTACH A CYCLING CLEAT

CROSS REFERENCE

This application is a continuation-in-part of U.S. application Ser. No. 13/009,855 entitled "Shoe Accessory for Cycling" and filed on Jan. 20, 2011 now abandoned.

BACKGROUND OF THE INVENTION

Cycling specific shoes with integral cleat attachment areas and ground contact preventing members are known. U.S. Pat. No. 5,125,173 assigned to Shimano describes such a cycling shoe. One problem with cycling specific shoes is that they are not offered in a wide variety of brands, models, styles and colors when compared to the number of brands, models, styles and colors offered in non-cycling shoes. This invention describes a kit and a method used to convert a non-cycling shoe of any brand, model, color or size to be a shoe which is equipped to attach a cycling cleat.

DESCRIPTION OF THE RELATED ART

For the purpose of this invention, a "non-cycling shoe" is defined as a shoe which is not built for attaching a cycling cleat.

Some bicycle pedals possess a mechanism which requires a cycling specific shoe with a cycling cleat attached to the bottom of the shoe in order to attach the shoe to the pedal. Wikipedia as of Jun. 13, 2013, defines a "cycling shoe" as:

> Cycling shoes are shoes purpose-built for cycling. There are a variety of designs depending on the type and intensity of the cycling for which they are intended. Key features include rigidity, for more efficient transfer of power from the cyclist to the pedals, weight, a method of attaching the shoe firmly to the pedal.

Cycling specific shoes generally consist of two types. The design details of these two different types of shoes are related to the type of pedal that is to be used. Furthermore, the pedal type is chosen by the cyclist to suit their particular cycling needs.

One type of pedal is referred to as a toe-clip pedal. These work with stirrup-like clips and adjustable straps to hold the foot in place on the pedal. Toe-clip pedals may be used with non-cycling shoes or with cycling specific shoes with a cleat attached. The cleat is a slotted cleat attached to the bottom outer sole of a cycling specific shoe using threaded fasteners. The slot in the cleat engages the front plate of the pedal in a tongue and groove manner. Toe clip pedals were commonly used by bicycle racers and riders, however the design has lost favor commercially due to a more popular pedal design referred to as clipless pedals. However, velodrome track cyclists use this type of cycling shoe with slotted cleats and toe clip pedals because of the secure mechanical connection provided by the slotted cleat engaged to the pedal combined with the toe straps. Another bicycle which may involve the use of toe-clip pedals is referred to as a fixed gear bicycle. These fixed gear bicycles are ridden on public streets and typically use similar equipment used by track cyclists. These urban fixed gear bicycles are most commonly ridden with non-cycling shoes. With non-cycling shoes, the cleat is absent so there is no engagement between a cleat and the front plate of the pedal. Cycling specific shoes designed to work with toe-clip pedals are difficult to obtain because this type of pedal system has been commercially displaced by the clipless pedal design. Any cycling specific shoes which are available for use with toe-clip pedals are limited regarding the options of brand, model, style and colors when compared to the options offered with non-cycling shoes.

Another type of pedal is the clipless pedal. This type of pedal has a spring loaded mechanism which receives and firmly holds a cleat. This cleat is attached to the bottom of the cycling shoe. The cycling shoe is disengaged from the pedal when the cyclist twists their foot in the appropriate direction to free the cleat from the spring loaded mechanism. Shoes designed for this type of pedal system fall into two categories. The two categories are differentiated by the shape of the cleat system they accommodate: narrow low profile clipless cleats, or wide platform clipless cleats. In general, the narrow low profile clipless cleats are used by bicycle riders who ride off-road, because the mechanism of the pedal is designed to be tolerant of debris, mud and dirt. Narrow low profile clipless cleats are sometimes referred to as off-road cleats. The wide platform clipless cleat is used by cyclists who ride primarily on the road; these are sometimes referred to as road cleats. Both of the cycling specific shoes designed for these cleats have a limited offering regarding the options of brand, model, style and colors when compared to the brands, models, styles and colors offered with non-cycling shoes.

Another type of bicycle pedal is the platform pedal. This simple pedal design has no mechanism for attaching a cycling shoe. This pedal is used with ordinary non-cycling shoes.

Examples of the narrow low profile cleats are the Shimano Pedal Design (referred to as SPD) including Shimano SM-SH-56, Shimano SH51, Shimano SH52; also Time Atac cleat design, Ritchey cleat design, Crank Brothers Egg Beater cleat design, Look Quartz cleat design and Look S-Track cleat design. Other brands with designs similar to SPD pedals exist but are not mentioned here. Low profile clipless pedals are typically found on mountain bike and other off road bicycles. Low profile clipless cleats offer the advantage of being more suited to walking in due to their low profile geometry. Cycling shoes designed for this type of cleat incorporate a sole which is substantially thick in the area of the cleat so that the cleat is prevented from contacting the ground. This device that prevents the cleat from touching the ground is referred to as a ground contact preventing member and there is usually one on each side of the cleat. These ground contact preventing members are typically integrally molded into the bottom of the sole and made of a resilient elastomer material which provides good traction on hard surfaces. A shoe that is designed to attach an SPD or any other off-road cleat is referred to as SPD compatible. These shoes referred to as off-road shoes, or SPD compatible shoes are made by companies whose offerings in models, styles and colors are limited when compared to the number of brands, models, styles and colors of non-cycling shoes that are available.

Examples of the wide platform cleats are Look Delta, Look Keo, Shimano SH-10 SPD-SL, and Shimano SM-SH11 SPD-SL. The pedals which these types of cleats mate with are typically used with road bicycles. Shoes designed for this type of pedal are usually equipped with a relatively rigid outer sole for optimum power transfer, and the cleat is attached to the bottom of the sole. These types of shoes are referred to as road shoes and are difficult to walk in, as they are optimized for pedaling. The bottom surface of road shoes are made of a hard and rigid material which does not provide sufficient traction to walk with when compared to non-cycling shoes. Also, these types of shoes are made by companies whose offerings in models, styles and colors are limited when compared to the number of brands, models, styles and colors of non-cycling shoes that are available.

U.S. Pat. No. 5,446,977 and U.S. Pat. No. 5,125,173, both assigned to Shimano Incorporated, are examples of a shoe which accommodates the Shimano Pedal Design which is designed for off-road use. The Shimano Pedal Design or SPD is so common that shoes which accept the SPD cleat are referred to as "SPD compatible" shoes, regardless of who manufactures the shoe. Likewise, narrow low-profile cleats are referred to as "SPD type cleats" regardless of who manufactures the cleat. Furthermore, all of the narrow low profile type cleats listed above will attach to a SPD compatible shoe since they share the same bolt pattern. This shoe design is also suitable for walking in. However this type of shoe is offered in a limited amount of brands, models, styles and colors when compared to the number of brands, models, styles and colors of non-cycling shoes that are available. If the shoe style and color does not suit the cyclist's requirement for fashion, the cyclist may not be as willing to purchase the shoe. The present invention is designed to overcome the limitation in choices of brands, models, styles and colors that can be used as cycling shoes.

U.S. Pat. No. 4,807,372 provides a solution which allows a cycling shoe with a cleat to be more suitable for walking in. In this case the cyclist is required to use a cycling specific shoe which offerings are limited in brands, models, styles and colors when compared to the number of brands, models, styles and colors of non-cycling shoes that are available.

Some shoe brands offer SPD compatible shoes that have been designed to appeal to cyclists with a need for fashion. Nike offered a shoe model called Gyrizo. The Nike Gyrizo shoe is fashionable and is SPD compatible; however it is not currently available for sale. Vans offers a shoe model called Warner, which is fashionable and SPD compatible, however the Warner is only available in a very limited number of colors. John Fluevog brand shoes offered a fashionable shoe model called the Race Vog which was SPD compatible; however this shoe is no longer available. Dromarti brand shoes currently offers cycling specific shoes which are fashionable and SPD or Look cleat compatible. DZR and Mission Labs are brands of urban cycling shoes which offer SPD compatible shoes and provide fashionable choices. However, the number of choices of brand, model, color and style of all of the choices mentioned above is limited when compared to the number of brands, models, styles and colors of non-cycling shoes that are available. The use of the kit and method defined in this patent will allow nearly any brand, model, style, size and color of shoe to be capable of attaching a cycling cleat.

ADVANTAGES

The industry offerings of cycling shoes includes a modest number of brands, models, styles and colors to choose from. In contrast, the industry offering for non-cycling shoes includes a relatively large number of brands, models, styles and colors to choose from. If a device is provided which accepts any clipless cleat design, or accepts a slotted cleat for a toe-clip pedal, this device could be fastened to a non-cycling shoe of any brand, model, color, or size. This non-cycling shoe would be modified to allow the attachment of the device which allows the attachment of cleats. The device would be securely fixed to the non-cycling shoe. With the device that a cleat can be attached to securely fixed to the non-cycling shoe, the non-cycling shoe would now be considered a cycling shoe because it is now capable of attaching a cleat to the shoe. Now a cyclist has a large number of choices of brands of non-cycling shoes, since they can all be converted into a cycling shoe with the matter described in this patent. The number of choices of brands, models, styles and colors of shoes which can be used for cycling with clipless or toe-clip pedals is now greatly increased over the offerings currently provided.

Some non-cycling shoes are offered in extremely lightweight options, some less than 200 grams per shoe. The Nike Zoom Victory Waffle is a good example of a light weight non-cycling shoe weighing 147 grams for a size US 10½ mens, compared to an equivalent cycling specific shoe which can be 400 grams per shoe. Converting the 147 gram shoe into a cycling shoe with the addition of the device that a cleat can be attached to would add less than 40 grams per shoe, making for a very light cycling shoe that weighs less than 200 grams per shoe.

BRIEF SUMMARY OF THE INVENTION

The present invention is directed at a kit and method for converting a non-cycling shoe to a cycling shoe. This invention overcomes the problems with the prior art, wherein now the cyclist can choose from a relatively large number of brands, models, colors, and sizes of shoes which can be converted and used as a cycling specific shoe. The kit includes the materials required to convert a non-cycling shoe into a shoe capable of attaching a cleat. More specifically, the kit includes a device which the cleat will be attached to, fasteners for attaching the device to the shoe, a template used to confirm the ideal location of the thru holes to be cut in the shoe, and instructions for how to modify the shoe to accept the device. The device is a contoured plate which is made of a material appropriate for the forces induced during pedaling and walking motions. The device could have no ground contact preventing members, ground contact members integrally mounted to it, or ground contact preventing members detachably mounted to it. It is the intent of this invention to describe a device which will accept all of the clipless cleats, thus any non-cycling shoe which is converted using the kit would be considered a shoe capable of attaching a cycling cleat.

The present invention is also directed at a method for converting a non-cycling shoe into a shoe capable of attaching a cycling cleat. The method includes the steps of (1) removing the comfort liner of the non-cycling shoe; and (2) using the template, confirming the most appropriate location for cutting the hole for the cleat attachment area and the holes for fastening the device to the shoe; (3) cutting the hole thru the shoe sole, the hole is shaped to accommodate the cleat attachment area of the device; (4) cutting the fastening holes thru the shoe sole; (5) trim the outline of the device to substantially match the interior of the shoe; and (6) insert the device into the interior of the shoe with the cleat attachment area appropriately aligned with the thru hole, and (6) the device is firmly attached to the inside of the shoe sole using threaded fasteners inserted in the fastening holes of the shoe and the holes of the device; and (7) the comfort liner is placed back in the shoe on top of the device. Now the shoe is capable of attaching an off-road cleat chosen from the group consisting of SPD, Time Atac, Crank Brothers, Ritchey off-road, Look Quartz, Look S-Track.

BRIEF DESCRIPTION OF THE DRAWINGS

FIG. 3*a* is a bottom view of a non-cycling shoe which has been modified with a thru hole which passes thru the sole. The thru hole is shaped for use with a device which a narrow low-profile clipless cleat can be attached to.

FIG. 5*a* is a bottom view of a non-cycling shoe which has been modified with a thru hole which passes thru the sole. The thru hole is shaped for use with a device which a narrow low-profile clipless cleat and ground contact preventing members can be attached to.

FIG. 7*a* is a bottom view of a non-cycling shoe which has been modified with a thru hole which passes thru the sole. The thru hole is shaped for use with a device which a narrow low-profile clipless cleat and ground contact preventing members can be attached to.

DETAILED DESCRIPTION OF THE INVENTION

Figure 1A:
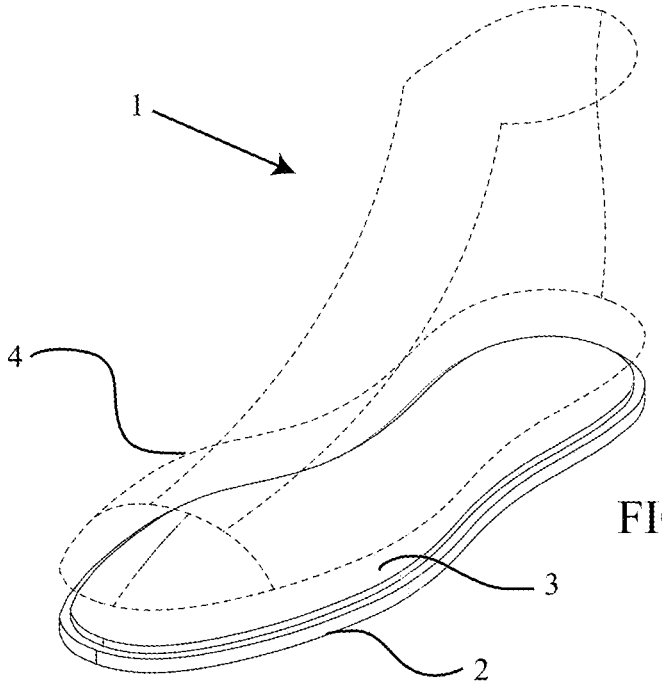
FIG. 1*a* is a top perspective view of a non-cycling shoe, including the inner sole and bottom sole, with the peripheral upper portion in phantom.
Figure 1B:
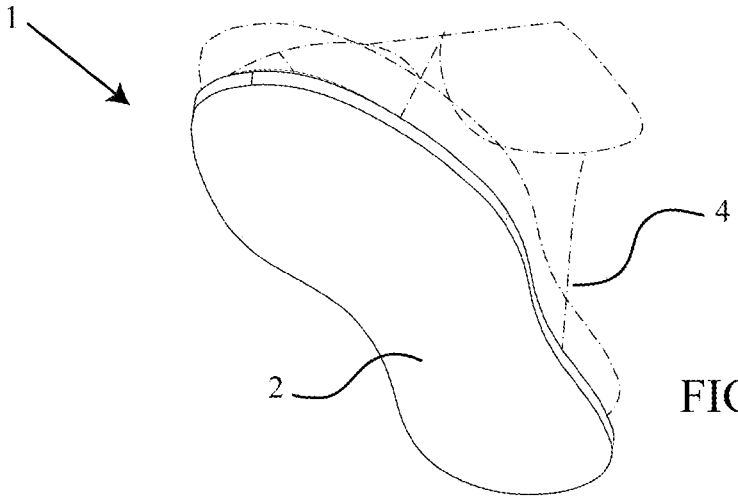
FIG. 1*b* is a bottom perspective view of the non-cycling shoe from FIG. 1*a*.

Referring first to FIG. 1*a*, a non-cycling shoe 1 is shown. The bottom sole 2 and inner liner 3 are identified in this drawing. The inner liner 3 is typically easy to remove from a non-cycling shoe. The peripheral portion 4, shown in phantom, of the shoe is for illustrative purposes only and forms no part of the claimed invention. Without modifications, the non-cycling shoe 1 has no means to safely and reliably attach a cycling cleat to the shoe. The current invention describes a kit and method to render the non-cycling shoe 1 of any brand, model, style, size, or color into a shoe capable of attaching narrow low-profile cleats.

Figure 2A:
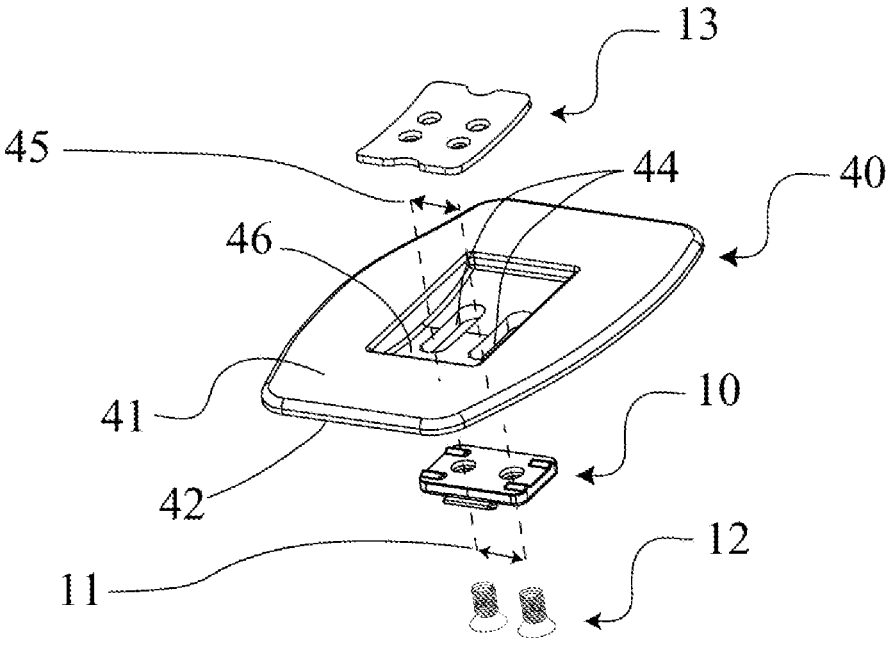
FIG. 2*a* is an exploded top perspective view of a device which a narrow low-profile clipless cleat can be attached to, showing the typical narrow low profile clipless cleat system components. The device does not have ground contact preventing members.
Figure 2B:
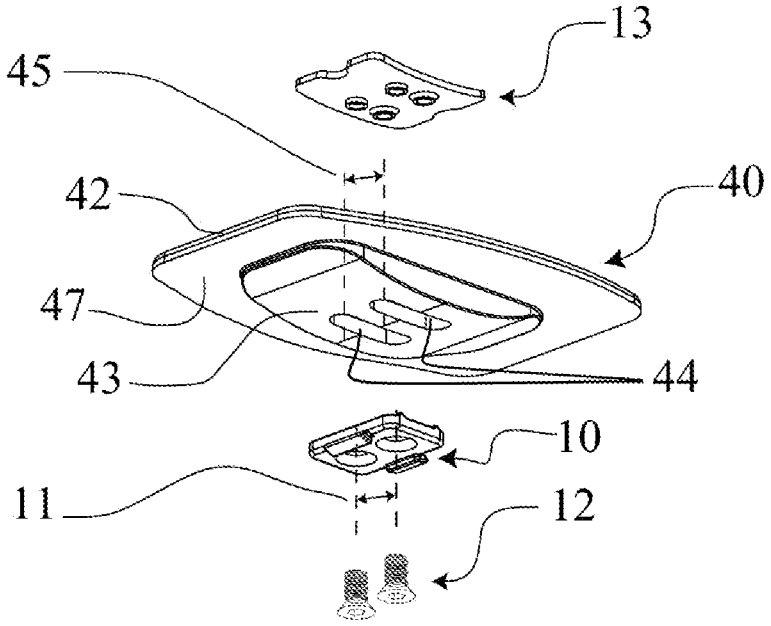
FIG. 2*b* is a bottom perspective view of the device in FIG. 2*a*.

FIGS. 2*a-b* illustrate a device 40 which a narrow low-profile clipless cleat 10 can be attached to. The contoured upper surface 41 of the device 40 is shaped appropriately to provide a comfortable surface for the cyclist's foot during riding and walking motions. In the preferred embodiment, the plan view outline 42 of the device is designed to fit only the front half of the shoe interior geometry; however the plan view perimeter outline shape 42 could match the entire interior outline of the shoe insole. The cleat attaching area 43 is shaped to accommodate narrow low profile cleats. Elongated slots 44 are provided to allow the cyclist to adjust the location of the cleat to suit their riding needs. The distance between centerlines 45 of the elongated slots 44 match the bolt pattern 11 of the narrow low profile clipless cleat 10. These elongated slots 44 are typical of cycling specific shoes which accommodate the narrow low profile cleat system. The recess 46 is shaped to receive a four hole threaded plate 13 required to fasten the narrow low-profile clipless cleat 10. The four hole threaded plate 13, is a common part available on the market. The threaded fasteners 12 have a flat head design so they are flush with the bottom of the cleat 10. The threaded fasteners 12 pass thru the cleat 10 and device 40 and thread into the four hole threaded plate 13 holding the assembly together. A plurality of devices could exist, each designed with a specific plan view profile perimeter outline shape 42 which fit appropriately in the shoe interior of each specific shoe size. In this embodiment, surface 47 will be fixed to the top surface of the inner sole of a shoe using adhesive.

Figure 3A:
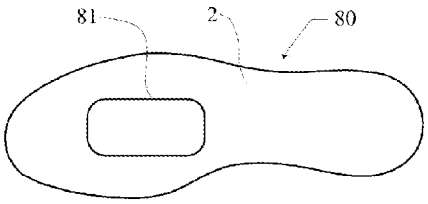
Figure 3B:
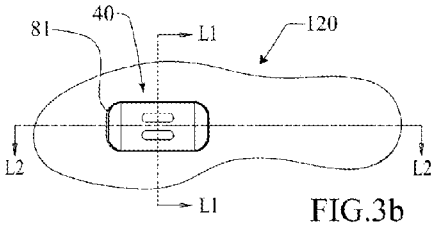
FIG. 3*b* is a bottom view of the shoe shown in FIG. 3*a*, with the device attached.
Figure 3C:
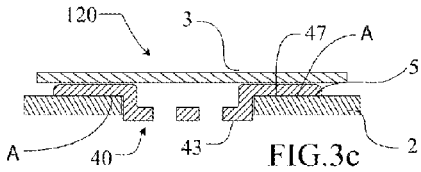
FIG. 3*c* is a section view taken along line L1 of FIG. 3*b*
Figure 3D:
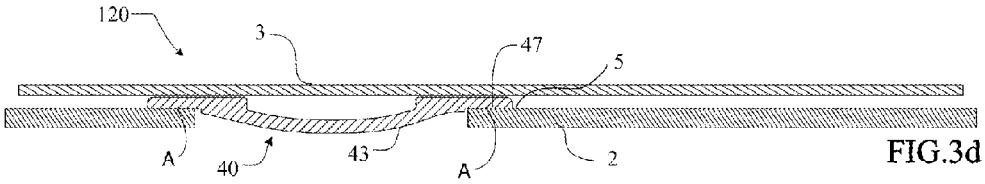
FIG. 3*d* is a section view taken along line L2 of FIG. 3*b*
Figure 3E:
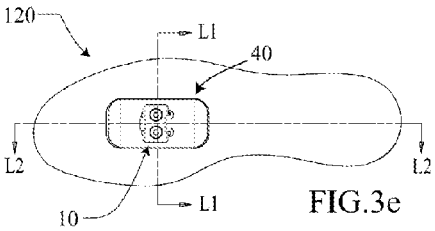
FIG. 3*e* is a bottom view of the shoe shown in FIG. 3*b*, with a narrow low profile cleat attached to the device.
Figure 3F:
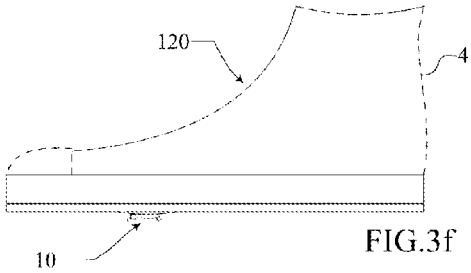
FIG. 3*f* is a side view of the shoe shown in FIG. 3*e*, with the peripheral portion of the shoe in phantom.
Figure 3G:
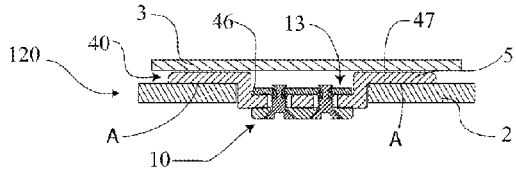
FIG. 3*g* is a section view taken along line L1 of FIG. 3*e*.
Figure 3H:
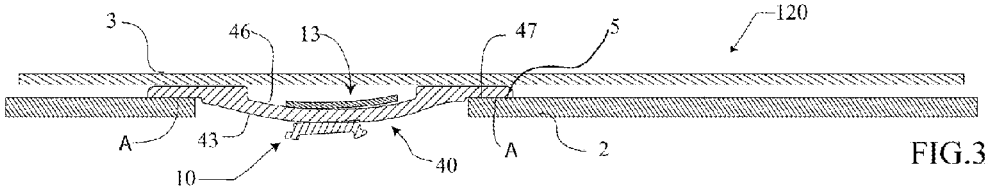
FIG. 3*h* is a section view taken along line L2 of FIG. 3*e*

FIG. 3*a* illustrates a non-cycling shoe 80 which has a hole 81 cut thru the bottom sole 2. FIG. 3*b* illustrates the same shoe 80 with the device 40 attached. The hole 81 is sized to accommodate the cleat attach surface 43 designed for the narrow low profile device 40. The location of the hole 81 is based on the design of the device 40 geometry and allows for the ideal location for a cycling cleat relative to the foot and pedal design. A non-cycling shoe with the hole 81 cut thru the bottom sole 2 and having a device 40 attached to the interior of the shoe is now considered a shoe capable of attaching a cycling cleat, or a shoe converted for cycling use 120. This non-cycling shoe which has been converted to a cycling shoe 120 illustrates the results of using the invention. The shoe 120 is capable of attaching any of the narrow low-profile cleats currently available. FIG. 3*c* is a section view taken along line L1 shown in FIG. 3*b*. The inner liner 3 is shown resting on top of the device 40. In this embodiment, the device 40 is fixed to the top surface 5 of the bottom sole 2 using adhesive, represented by an 'A', between the surface 47 of the device 40 and the top surface 5 of the bottom sole 2. FIG. 3*d* is a section view taken along the line L2 shown in FIG. 3*b*. FIG. 3*e* is a bottom view of shoe 120 with a narrow low profile cleat 10 attached to the device 40, using the appropriate fastening hardware. FIG. 3*f* is a side view of a shoe 120 with a narrow low profile cleat 10 attached; this view shows how the cleat 10 might protrude from the bottom of the shoe. The peripheral portion 4 of the shoe shown in phantom lines is for illustrative purposes only and forms no part of the claimed invention. FIG. 3*g* is a section view taken along line L1 shown in FIG. 3*e*, showing the narrow low profile cleat 10 attached. The four hole threaded plate 13 is shown nested into the recess 46 of the device 40. FIG. 3*h* is a section view taken along line L2 shown in FIG. 3*e*, showing the narrow low profile cleat 10 attached to the device 40.

Figure 4A:
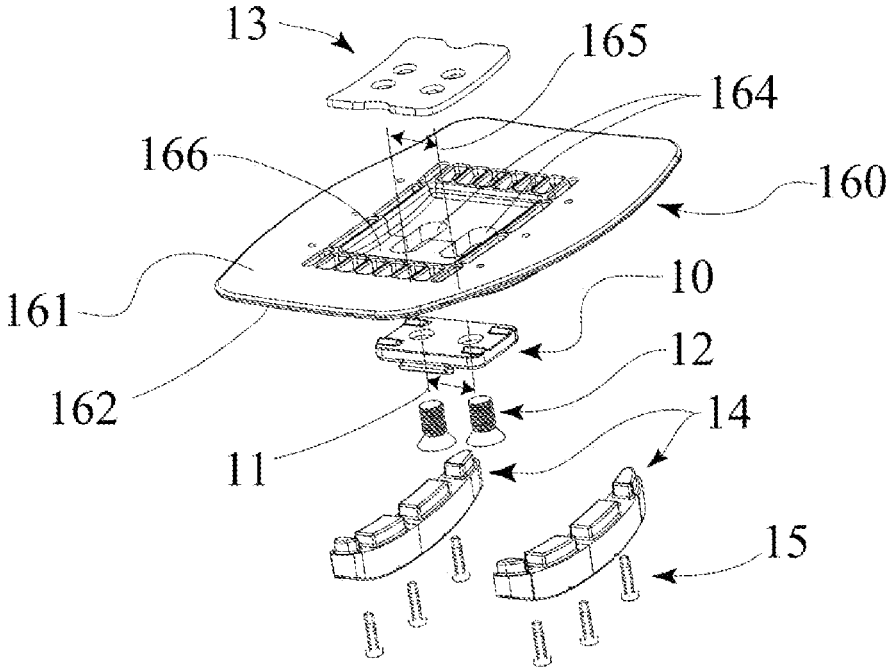
FIG. 4*a* is an exploded top perspective view of a device which a narrow low-profile clipless cleat can be attached to, showing the typical narrow low profile clipless cleat system components. Shown in this assembly are the elastomer ground contact preventing devices.
Figure 4B:
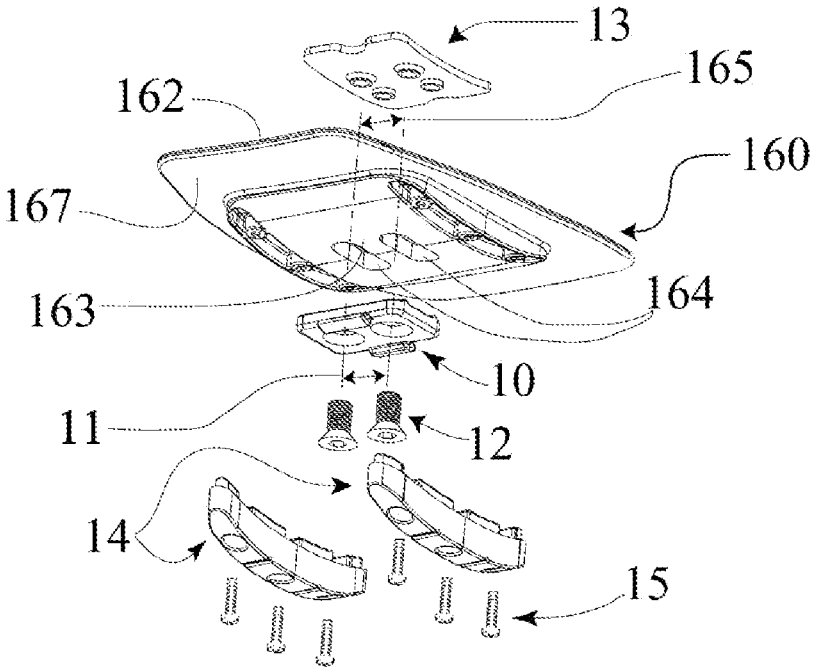
FIG. 4*b* is a bottom exploded perspective view of the device shown in FIG. 4*a*.

FIGS. 4*a-b* illustrate a device 160 which a narrow low-profile clipless cleat 10 can be attached to. The contoured upper surface 161 of the device 160 is shaped appropriately to provide a comfortable surface for the cyclist's foot during riding and walking motions. In the preferred embodiment, the plan view perimeter outline shape 162 of the device is designed to fit the front half of the shoe interior geometry; however the plan view perimeter outline shape 162 could substantially match the entire interior portion of the shoe insole. The cleat attaching surface 163 is shaped in a manner required to accommodate narrow low profile cleats. The cleat attach surface 163 can be shaped to accommodate the thickness of the sole of the specific brand and model of shoe the accessory device is designed for. More specifically, in the preferred embodiment the cleat attachment surface 163 protrudes a maximum of 6 mm distance from surface 167. If a shoe possesses a sole that is more than 12 mm thick, the cleat attachment surface 163 will have to protrude more than 6 mm from surface 167 in order for the cleat to engage the pedal mechanism. For example if a shoe has a sole that is 20 mm thick, the cleat attach surface 163 will have to protrude 14 mm from surface 167. Elongated slots 164 are provided to allow a cyclist to adjust the location of the cleat 10. The distance between centerlines 165 of the elongated slots 164 matches the bolt pattern 11 of the narrow low profile clipless cleat 10. These elongated slots 164 are typical of cycling specific shoes which accommodate the narrow low profile cleat system. The recess 166 is shaped to receive the four hole threaded plate 13 required to mount the narrow low-profile clipless cleat 10. The threaded fasteners 12 pass thru the cleat 10 and device 160 and thread into the four hole threaded plate 13 holding the assembly together. The threaded fasteners 12 are of the flat head screw type, so the head is flush with the bottom surface of the cleat 10. A plurality of devices could exist, each designed with a specific plan view perimeter outline shape 162 which fit appropriately in the shoe interior of each specific shoe size. Or a single device could exist with a sufficiently oversized plan view perimeter outline shape 162, such that the device could be trimmed to substantially fit the front half of the interior of the shoe, or the entire interior of the shoe. Surface 167 will be fixed to the top surface of the interior sole of a shoe using adhesive. The ground contact preventing members 14 are slightly taller than the clipless cleat 10 and therefore prevent the cleat 10 from contacting the ground while walking. The ground contact preventing members 14 can be attached to the device 160 using threaded fasteners 15. The ground contact preventing members 14 may also be fixed to the device 160 using any number of other common attaching methods including in-molding, two shot molding, adhesives or snap fits. The ground contact preventing members 14 are made of an elastomer material which possesses a resilience characteristic to provide walking comfort similar to ordinary shoes.

Figure 5A:
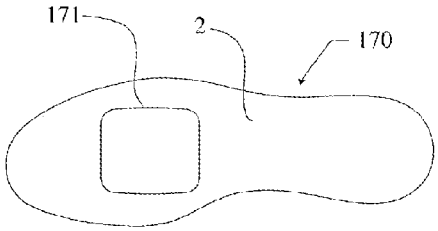
Figure 5B:
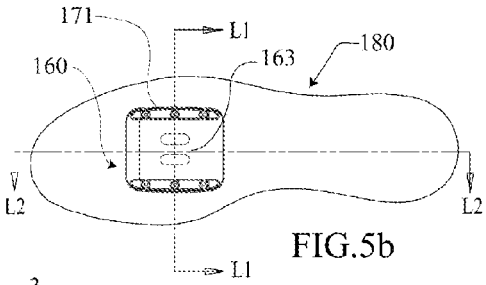
FIG. 5*b* is a bottom view of the shoe shown in FIG. 5*a*, with the device attached.
Figure 5C:
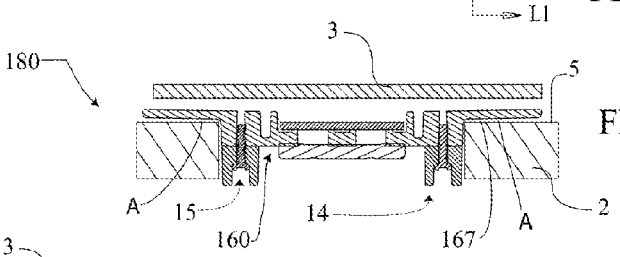
FIG. 5*c* is a section view taken along line L1 of FIG. 5*b*
Figure 5D:
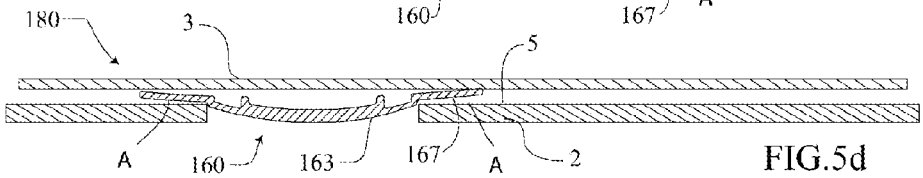
FIG. 5*d* is a section view taken along line L2 of FIG. 5*b*
Figure 5E:
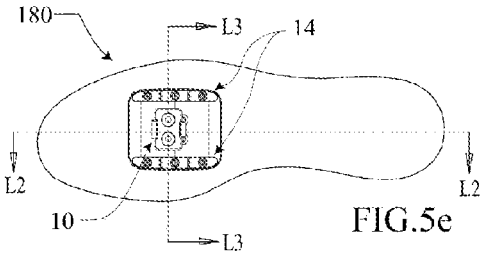
FIG. 5*e* is a bottom view of the shoe shown in FIG. 5*b*, with a narrow low profile cleat attached to the device. Shown in this view are the ground contact preventing members.
Figure 5F:
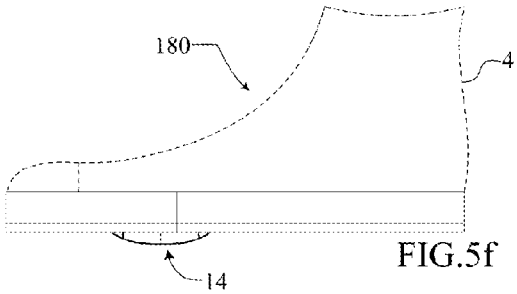
FIG. 5*f* is a side view of the shoe shown in FIG. 5*e*, with the peripheral portion of the shoe in phantom.
Figure 5G:
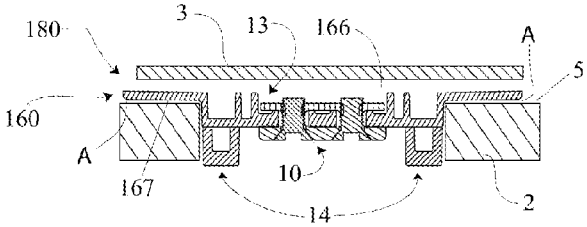
FIG. 5*g* is a section view taken along line L3 of FIG. 5*e*.
Figure 5H:
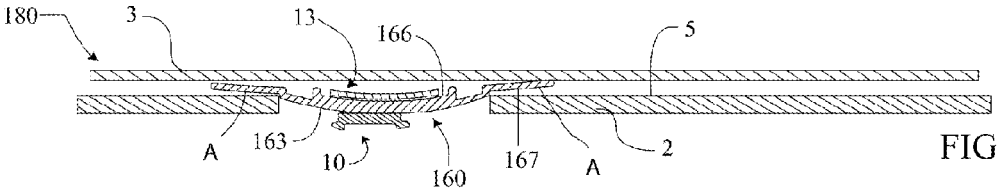
FIG. 5*h* is a section view taken along line L2 of FIG. 5*e*

FIG. 5*a* illustrates a non cycling shoe 170 which has a hole 171 cut thru the bottom sole 2. FIG. 5*b* illustrates the same shoe 170 with the device 160 attached. The hole 171 is sized to accommodate the cleat attach surface 163 and the ground contact preventing members 14. The location of the hole 171 is based on the design of the device 160 geometry and allows for the ideal location for a cycling cleat relative to the foot and pedal design. A non-cycling shoe with the hole 171 cut thru the bottom sole 2 and having a device 160 attached to the interior of the shoe is now considered a shoe capable of attaching a cycling cleat, or a shoe converted for cycling 180. This non-cycling shoe which has been converted to a cycling shoe 180 illustrates the results of using the invention. The shoe 180 is capable of attaching any of the narrow low-profile cleats currently available. FIG. 5*c* is a section view taken along line L1 shown in FIG. 5*b*, the ground contact preventing members 14 are shown detachably mounted to the device 160 using the screws 15. The inner liner 3 is shown resting on top of the device 160. In one embodiment, the device 160 is fixed to the top surface 5 of the bottom sole 2 using an adhesive, represented by an 'A', between the surface 167 of the device 160, and the surface 5 of the bottom sole 2. FIG. 5*d* is a section view taken along the line L2 shown in FIG. 5*b*. FIG. 5*e* is a bottom view of shoe 180 with a narrow low profile cleat 10 attached to the device 160, using the appropriate fastening hardware. FIG. 5*f* is a side view of the shoe 180 with a narrow low profile cleat 10 attached; this view shows how the ground contact preventing members 14 would prevent the cleat 10 from contacting the ground. The peripheral portion 4 of the shoe shown in phantom lines is for illustrative purposes only and forms no part of the claimed invention. FIG. 5*g* is a section view taken along line L3 shown in FIG. 5*e*, showing the narrow low profile cleat 10 attached, and the ground contact preventing members 14, which are slightly taller than the cleat 10. The four hole threaded plate 13 is shown nested into the recess 166 of the device 160. FIG. 5*h* is a section view taken along line L2 shown in FIG. 5*e*, showing the narrow low profile cleat 10 attached.

Figure 6A:
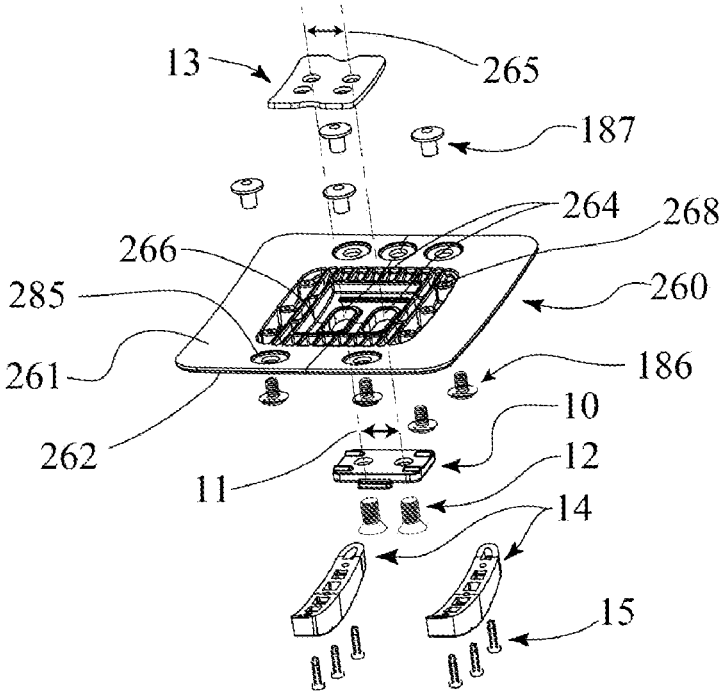
FIG. 6*a* is an exploded perspective view of a device which a narrow low-profile clipless cleat can be attached to, showing the typical narrow low profile clipless cleat system components. Shown in this assembly are the elastomer ground contact preventing members and the fasteners that will be used to mount the device to the shoe.
Figure 6B:
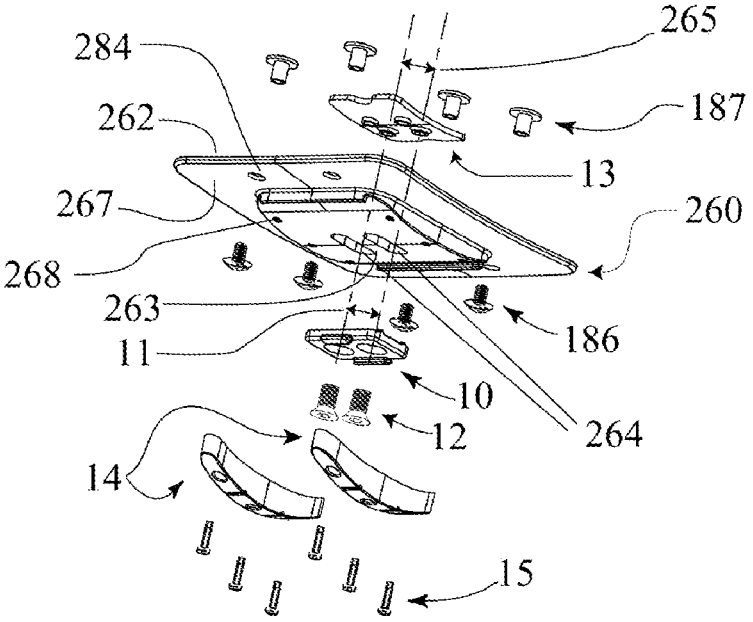
FIG. 6*b* is a bottom exploded perspective view of the device shown in FIG. 6*a*.

FIGS. 6*a-b* illustrate a device 260 which a narrow low-profile clipless cleat 10 can be attached to. The contoured upper surface 261 of the device 260 is shaped appropriately to provide a comfortable surface for the cyclist's foot during riding and walking motions. In one embodiment, the plan view perimeter outline shape 262 of the device is designed to fit the front half of the shoe interior geometry; however the plan view perimeter outline shape 262 could resemble the entire interior portion of the shoe insole. In the preferred embodiment the plan view perimeter shape 262 is a rectangle shape which is oversized sufficiently so that it may be cut to fit the front ½ of the shoe interior geometry. This rectangle shaped plan view perimeter 262 could allow one device to work with a left or a right shoe and fit into shoes ranging from US size 6 Men's to US 13 Men's. The device 260 could be trimmed using a cutting tool chosen from the group consisting of a manual trimming snips, a bandsaw, a computer controlled cutting bit, a computer controlled water jet cutter, a steel rule die and a press. The cleat attaching surface 263 is shaped in the manner required to accommodate narrow low profile cleats. Elongated slots 264 are provided to allow a cyclist to adjust the location of the cleat 10. The distance between centerlines 265 of the elongated slots 264 matches the bolt pattern 11 of the narrow low profile clipless cleat 10. These elongated slots 264 are typical of cycling specific shoes which accommodate the narrow low profile cleat system. The recess 266 is shaped to receive the four hole threaded plate 13 required to mount the narrow low-profile clipless cleat 10. The threaded fasteners 12 pass thru the cleat 10 and device 260 and thread into the four hole threaded plate 13 holding the assembly together. The shoe attachment area is a surface 267 on the underside of the plate. The mounting holes 284 pass thru the upper surface 261 and the underside surface 267. There can be one or more mounting holes 284, the preferred number of mounting holes 284 is five, where only four threaded fasteners 186 and four binding posts 187 are used. FIG. 6*a-b* show five mounting holes 284, the additional hole being the center hole in the group of three. This additional hole is used when converting a very narrow cycling shoe where the arch of the shoe prevents the use of the adjacent mounting hole thru the shoe sole. The shoe connectors consist of a male threaded screw 186 and female binding bolt 187, both with substantially oversize heads to distribute the forces generated during walking and pedaling motions. The counterbore 285 associated with each mounting thru hole 284 are designed to insure the low profile head of the binding post 187 is substantially flush with the top surface 261 of the device 260. The ground contact preventing members 14 are slightly taller than the clipless cleat 10 and therefore prevent the cleat 10 from contacting the ground while walking. The ground contact preventing members 14 can be attached to the device 260 using threaded fasteners 15 that thread into holes 268. The ground contact preventing members 14 can be removed and replaced if they show signs of wear. The ground contact preventing members 14 may also be fixed to the device 260 using any number of other common attaching methods including in-molding, two shot molding, adhesives or snap fits. The ground contact preventing members 14 are made of an elastomer material which possesses a resilience characteristic to provide walking comfort similar to ordinary shoes.

Figure 7A:
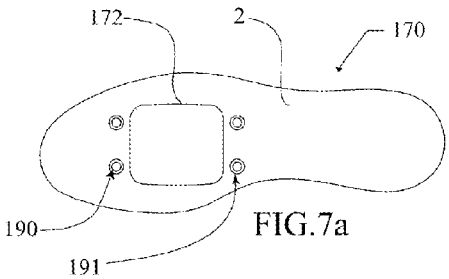
Figure 7B:
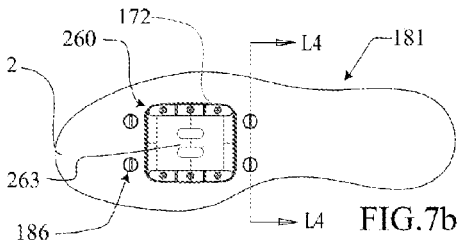
FIG. 7*b* is a bottom view of the shoe shown in FIG. 7*a*, with the device attached.
Figure 7C:
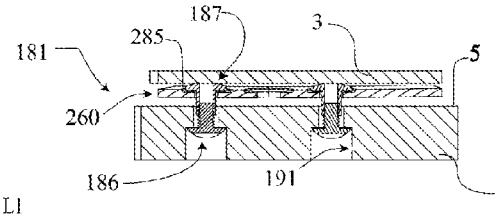
FIG. 7*c* is a section view taken along line L4 of FIG. 7*b*
Figure 7D:
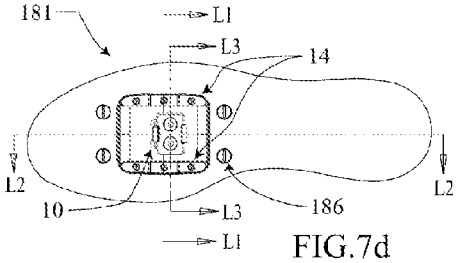
FIG. 7*d* is a bottom view of the shoe with a cleat attached.
Figure 7E:
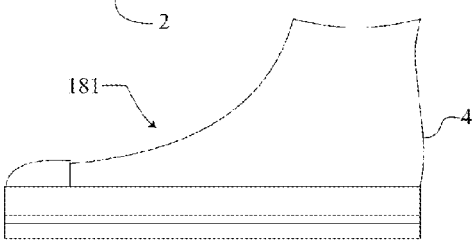
FIG. 7*e* is a side view of the shoe shown in FIG. 7*d*, with a narrow low profile cleat attached to the device.
Figure 7F:
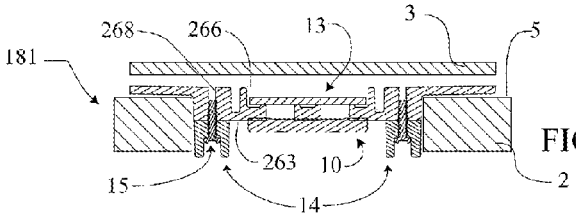
FIG. 7*f* is a section view taken along line L1 in FIG. 7*e*.
Figure 7G:
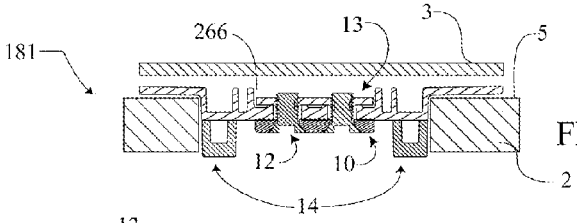
FIG. 7*g* is a section view taken along line L3 of FIG. 7*d*.
Figure 7H:
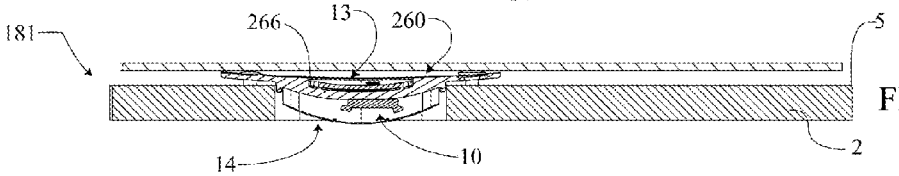
FIG. 7*h* is a section view taken along line L2 of FIG. 7*d*.

FIG. 7*a* illustrates a non-cycling shoe 170 which has a hole 172 and mounting thru holes 190 cut thru the bottom sole 2. FIG. 7*a* also shows counterbored holes 191 cut in the bottom surface of the bottom sole 2. FIG. 7*b* illustrates the same shoe 170 with the device 260 attached using four threaded fasteners 186 which are visible and connected to four threaded posts 187 which are not visible. The thru hole 172 is sized to accommodate the cleat attach surface 263 and ground contact preventing members 14. The location of the thru hole 172 is based on the design of the device 260 geometry and allows for the ideal location for a cycling cleat relative to the foot and pedal design. A non-cycling shoe with the hole 172 cut thru the bottom sole 2 and having a device 260 attached to the interior of the shoe is now considered a shoe capable of attaching a cycling cleat, or a shoe converted for cycling 181. This non-cycling shoe which has been converted to a cycling shoe 181 illustrates the results of using the invention. The shoe 181 is capable of attaching a SPD, Time ATAC, Crank Brothers, Ritchey or any of the narrow low profile cleats currently available. FIG. 7*c* is a section view taken along line L4 shown in FIG. 7*b*, this section view occurs thru the mid-plane of the threaded fasteners 186. The insole 3 is shown resting on top of the device 260. In this embodiment, the device 260 is fixed to the top surface 5 of the bottom sole 2 using the threaded fasteners 186 and 187. In the preferred embodiment, a #8-32 stainless steel pan head screw 186 with a slotted drive is threaded to a #8-32×¼" stainless steel binding post 187 (also known as a Chicago screw or a binding screw) FIG. 7*c* illustrates the counterbored recess 191 in the bottom of the sole 2 which insures the threaded fastener 186 is recessed relative to the sole 2 and does not touch the ground. The top surface of the device 260 has a counterbored recess 285 which insures the head of the binding post 187 is substantially flush with the top surface of the device 260. FIG. 7*d* is a bottom view of shoe 181 with a narrow low profile cleat 10 attached to the device 260. FIG. 7*e* is a side view of the shoe 181 with a narrow low profile cleat 10 attached; this view shows how the ground contact preventing members 14 do not protrude past the bottom of the sole 2 of the shoe. The peripheral portion 4 of the shoe shown in phantom lines is for illustrative purposes only and forms no part of the claimed invention. FIG. 7*f* is a section view taken on line L1 shown in FIG. 7*d*, showing the attaching screws 15 which hold the ground contact preventing members 14 which are slightly taller than the cleat 10 to the cleat attachment plate 260. FIG. 7*g* is a section view taken along line L3 shown in FIG. 7*d*, showing the narrow low profile cleat 10 attached, and the ground contact preventing members 14, which are slightly taller than the cleat 10. FIG. 7*d* also shows how the flat head screws 12 are flush with the bottom of the cleat 10. The four hole threaded plate 13 is shown nested into the recess 266 of the device 260. FIG. 7*h* is a section view taken along line L2 shown in FIG. 7*d*, showing the narrow low profile cleat 10 attached.

Figure 8:
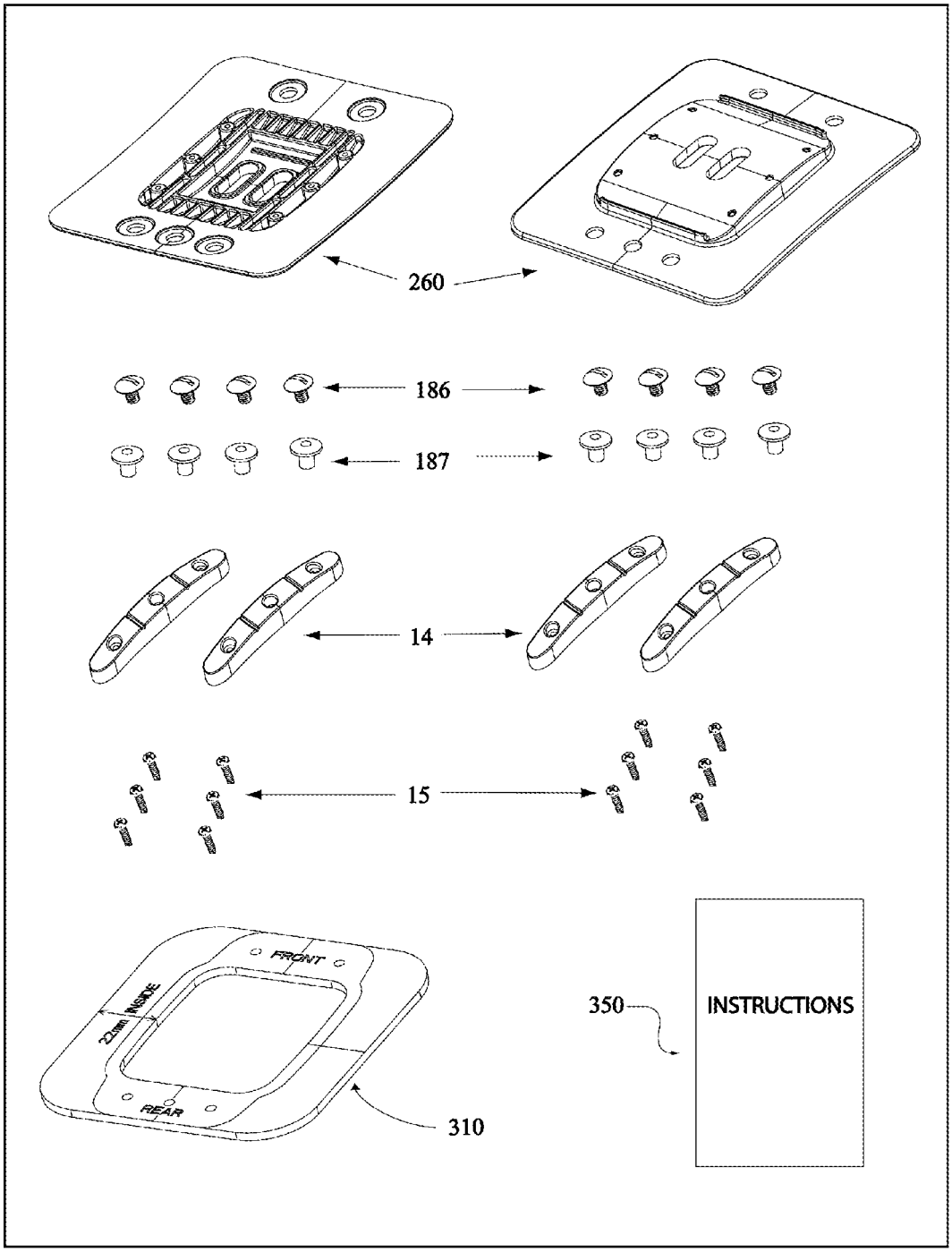
FIG. 8 shows the elements of the kit that may be used to convert a non-cycling shoe into an SPD compatible shoe.

FIG. 8 illustrates the kit 300 that includes the parts that can be used to convert a non-cycling shoe so that an SPD cycling cleat can be attached. The preferred embodiment of the kit described in this invention includes two devices 260 which a cycling cleat can be connected to, eight male threaded fasteners 186 and eight female binding posts 187, four ground contact preventing members 14 which are bumper shaped and made of an elastomer, twelve screws 15 which are thread forming screws for plastic used to secure the bumpers 14 to the injection molded nylon device 260, a template 310 and an instruction manual 350.

Figure 9A:
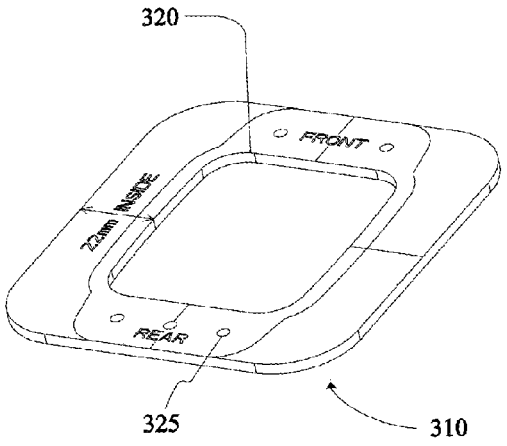
FIG. 9*a* shows a perspective view of the template that is used to confirm the ideal location for the thru holes that will be cut thru the sole of the non-cycling shoe.
Figure 9B:
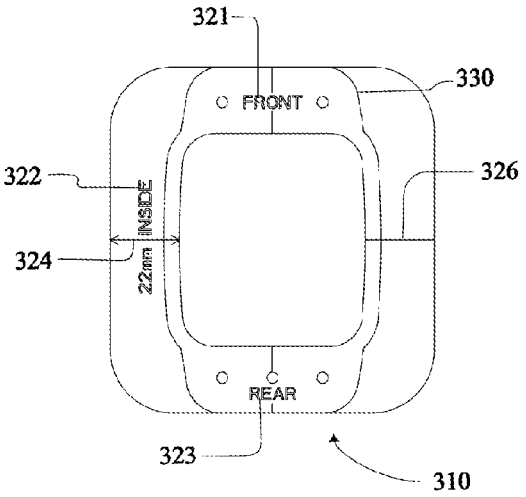
FIG. 9*b* is a plan view of the template shown in FIG. 9*a*.
Figure 9C:
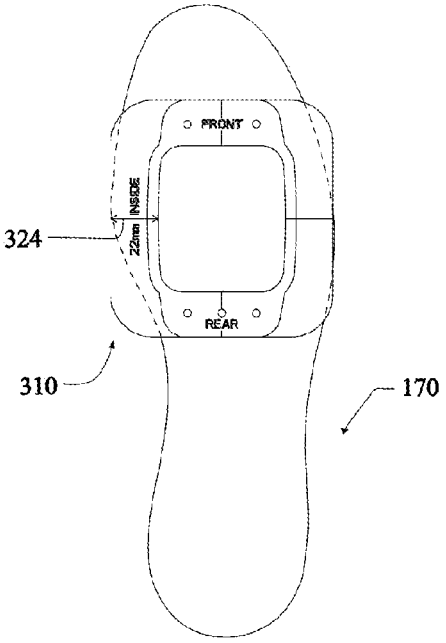
FIG. 9*c* is a bottom view of a left shoe with the template placed on the sole.

FIG. 9*a-c* describes a template 310 that is used to confirm the ideal location for cutting a thru hole 172 and fastening holes 190 in the shoe sole to accommodate the device 260. FIG. 9*a* shows the template 310 with a main thru hole 320 and five mounting thru holes 325. The relative dimensions between the holes 320 and 325 of the template 310 match the relative dimensions of the thru holes 172 and 190 of the device 260. This template 310 could be made of transparent acrylic sheet that is laser cut, or cardboard, or paper, or metal or plastic. The template 310 could have text engraved or printed on the surface. The text "FRONT" 321, "22 mm INSIDE" 322 and "REAR" 323 as well as the arrow markings 324, centerline markings 326 and a line defining the boundary of a keep out zone 330 could all be included on the surface of the template to assist with the proper placement of the thru hole 172 and mounting thru holes 190 relative to the geometry of the shoes. FIG. 9*b* shows the template 310 placed on the sole of a non-cycling shoe 170. FIG. 9*c* shows how the template could be used to line up the arrow 324 with the inside edge of the shoe 170 sole. This alignment would guarantee the thru hole 320 to be cut would be 22 mm from the inside edge of the widest point of the shoe 170, this insures the cleat centerline will be 50 mm from the inside edge of the shoe, which in turn insures there will be 5 mm clearance between the inside edge of the shoe and the crank arm. FIG. 9*c* also shows how none of the bottom sole of the shoe would intersect or pass into the keep out zone defined by line 330 which is printed on the template 310.

Regarding the modification of a non-cycling shoe 170 into a shoe which is capable of receiving the device described in this patent: the thru holes 171, 172 and 190 in the sole can be created by using any number of manufacturing techniques for cutting thru the types of materials commonly found in shoe soles. The thru holes 171, 172 and 190 can be formed using a computer controlled cutting machine which cuts with a laser, metal cutting bit, abrasive disk or water jet cutting technology. The thru holes 171, 172 and 190 can also be formed using manual methods including a small Exacto serrated saw blade or similar hand operated cutting tool. In the preferred embodiment the thru hole is created with a steel rule die and a press with sufficient force to cut thru the sole of a shoe.

The device is attached to the top surface 5 of the bottom sole 2 of the shoe using any one or a combination of different attachment methods, including pressure sensitive adhesive, very high bond adhesive, contact adhesive, adhesives, threaded fasteners, rivets, heat staking, or ultrasonic welding. In the preferred embodiment, the device is assembled to the shoe using threaded fasteners.

The device can be manufactured in any of many different materials including titanium, aluminum, injection molded thermoplastic materials, thermoset materials, carbon fiber, or fiberglass reinforced plastic. The preferred embodiment finds the device made of injection molded impact modified nylon.

The method of use of a non-cycling shoe which has been converted to a cycling shoe involves cycling and walking. During cycling, the cleat is clipped into the mechanism of a clipless pedal. During walking, the bottom sole 3 makes contact with the ground. In the case that the shoe is converted to use with a narrow low profile cleat 10, the ground contact preventing members 14 can be installed to prevent the cleat 10 from touching the ground while walking. The ground contact preventing members 14 can be detachably mounted to the device 260, thus allowing for replacement in the case of excessive wear caused by walking. The mounting of the ground contact preventing members 14 can be achieved using screws, rivets, adhesives or snap fits. In the preferred embodiment of the invention, the ground contact preventing members 14 are installed using thread forming screws for plastics 15. Another embodiment finds the ground contact preventing members 14 integrally mounted to the device 160.

It is to be understood that the invention is not limited to the illustrations described and shown herein, which are deemed to be merely illustrative of the best modes of carrying out the invention, and which are susceptible of modification of form, size, and arrangement of parts and details of operation. The invention rather is intended to encompass all such modifications that are within its spirit and scope as defined by the claims.

What is claimed is:

1. A kit for converting a non-cycling shoe into a shoe which is capable of attaching a cycling cleat, the kit comprising:

(a) a device which is a contoured plate substantially the size of a front half of a sole of the shoe with a topside and an underside, where the topside has a recessed area, where the underside has a cleat attachment area adapted to protrude through a thru hole which is cut in the sole, where the cleat attachment surface area is adapted to attach a cycling cleat, where the underside includes a shoe attachment area, where the shoe attachment area includes one or more shoe mounting holes for mounting the device to the sole, where the device has one or more ground contact preventing member mounting holes, where the device contoured plate of the device attaches to the interior is assembled under a removable inner liner of a non-cycling shoe by inserting the device thru the thru hole which is cut in the shoe, thus the shoe attachment area of the contoured plate contacts the top surface of the bottom sole and the cleat attachment area protrudes thru the thru hole;

(b) one or more detachable ground contact preventing members, where the ground contact preventing members are mounted on either side of the cleat attachment area, where the one or more detachable ground contact preventing members have one or more securing holes to secure the one or more detachable ground contact preventing members to the device, where the securing holes align with the ground contact preventing member mounting holes of the device:

(c) one or more first connectors to mount the shoe to the device through the shoe mounting holes;

(d) one or more second connectors for fastening the detachable ground contact preventing members to the device; and (e) a template for identifying a location on the sole for the one or more mounting holes, and the thru hole for the cleat attachment surface of the device.

2. The kit of claim 1, where the cleat attachment surface is adapted to attach to a narrow low-profile an SPD type off-road cleat.

3. The kit of claim 1 where the ground contact preventing members are replaceable when the ground contact preventing members they show wear.

4. The kit of claim 1 where the ground contact preventing members are made of elastomer.

5. The kit of claim 1, where the one or more connectors for mounting the shoe attachment area to the shoe is are chosen from the group consisting of adhesive, a pressure sensitive adhesive, a very high bond adhesive, a contact adhesive, threaded fasteners, rivets, heat staking or ultrasonic welding.

* * * * *